United States Patent [19]

Gaffney

[11] 4,338,691

[45] Jul. 13, 1982

[54] BATHTUB AID FOR HANDICAPPED

[76] Inventor: Edward J. Gaffney, Highway SS, Pewaukee, Wis. 53072

[21] Appl. No.: 108,882

[22] Filed: Dec. 31, 1979

[51] Int. Cl.[3] ..... A47K 3/12

[52] U.S. Cl. ..... 4/562; 4/573; 4/604; 5/82 R; 296/20

[58] Field of Search ..... 4/538, 540, 546, 547, 4/548, 550, 551, 555, 559, 560–562, 564, 565, 571, 572, 573, 575, 578, 585–587, 592, 604; 414/921; 5/82 R, 81 R, 86; 280/650, 657; 296/20

[56] References Cited

U.S. PATENT DOCUMENTS

| | | | |
|---|---|---|---|
| 1,723,673 | 8/1929 | Bauer . | |
| 2,439,163 | 4/1948 | Farmer | 5/86 |
| 2,495,482 | 1/1950 | Rogatz | 4/572 X |
| 2,517,443 | 8/1950 | Rhodes et al. . | |
| 2,680,855 | 6/1954 | Robinson . | |
| 2,700,776 | 2/1955 | Walters | 4/572 |
| 3,104,399 | 9/1963 | Dalton | 4/562 |
| 3,220,575 | 11/1965 | Batty et al. | 5/81 R X |
| 3,758,894 | 9/1973 | Finley | 4/560 X |
| 3,822,421 | 7/1974 | Lorén | 4/546 X |
| 3,999,227 | 12/1976 | Ingemansson | 5/81 R X |
| 4,170,045 | 10/1979 | Estes | 4/592 X |
| 4,207,629 | 6/1980 | Kagawa | 4/540 |
| 4,230,364 | 10/1980 | Parker | 4/560 X |

FOREIGN PATENT DOCUMENTS

| | | |
|---|---|---|
| 2427818 | 7/1943 | France . |
| 14590 | of 1915 | United Kingdom . |
| 813353 | 5/1959 | United Kingdom . |

*Primary Examiner*—Stuart S. Levy

*Attorney, Agent, or Firm*—Henry C. Fuller

[57] ABSTRACT

Disclosed herein is an appliance for transporting an invalid or handicapped patient to and from a bathtub and for supporting the patient while in a tub. An elongated generally rectangular frame is provided with a web having a pocket which forms a seat for the patient, with the pocket surrounded by a U-shaped fulcrum bar which protects the patient's hips and buttocks. The fulcrum bar enables loading of the appliance into the tub without the attendant handling the entire load. The appliance can also be used as a comfortable, stable all purpose seat for a handicapped patient.

7 Claims, 14 Drawing Figures

Fig. 3
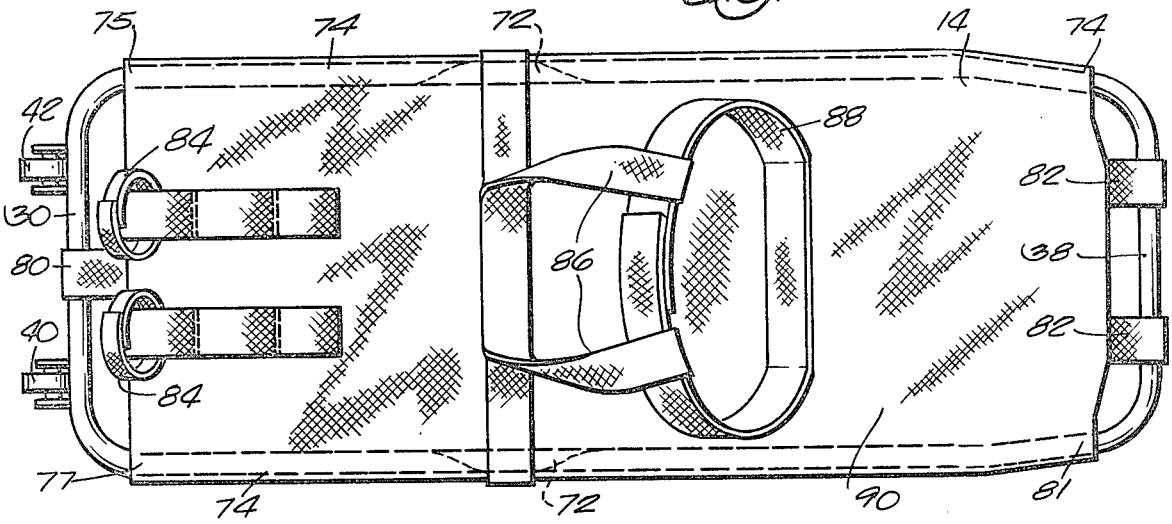
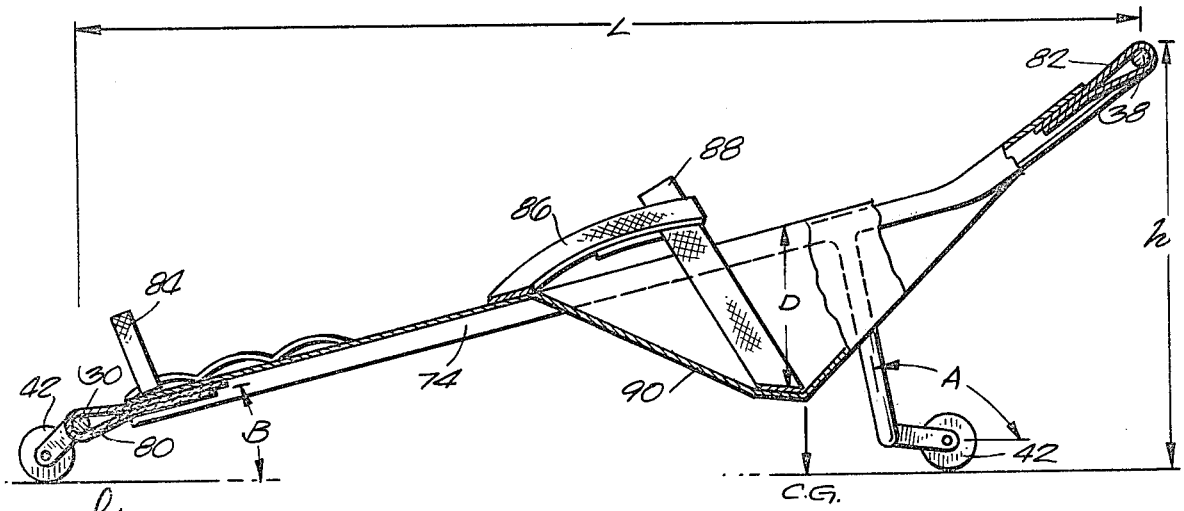
Fig. 2.
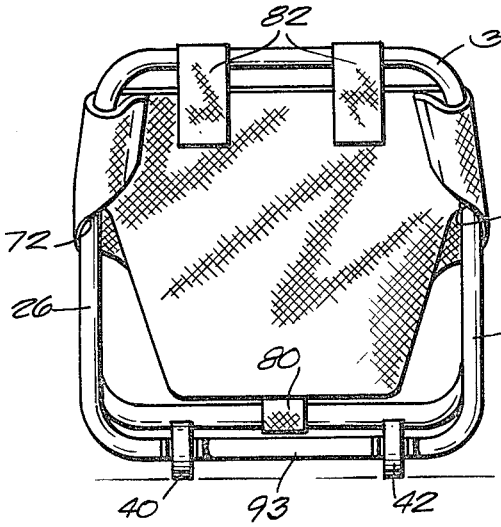
Fig. 4

BATHTUB AID FOR HANDICAPPED

BACKGROUND OF THE INVENTION

The present invention relates to a device which can be used for transporting a handicapped child to and from a bed to a bathtub and supporting the child in the tub while being bathed by an attendant. The device can also be used as a seat.

Various appliances are presently available to aid in bathing invalids or the handicapped. The Dalton U.S. Pat. No. 3,104,399 and Farmer U.S. Pat. No. 2,439,163 are illustrative of hydraulic lifts for raising patients from a bed and transferring them to a chair or bathtub. A similar device is marketed under the name Hoyer Patient Lifter and includes a sling for supporting the patient during the use thereof. The Batty U.S. Pat. No. 3,220,575 also shows a lift. These devices are expensive and difficult to manipulate, particularly in the confines of small bathrooms.

Another category of device is a bath seat which is either a self-supporting plastic bucket seat with a support harness or a frame with a web or sling which is supported on a frame within the tub to support the handicapped child or patient while being bathed by an attendant. A device of this character is advertised in "The Exceptional Parent" of August 1978 by LaCaron Industries, Inc. A device called a Support-A-Bather, employing a metal tubular frame and hammock sling, is sold by Modular Medical Corporation. Rehabilitation Engineering of the Ontario Crippled Children's Center, Toronto, Ontario, markets a bath frame which employs a tubular steel frame with suction cups and lawn chair webbing to support a child. U.S. Pat. No. 3,999,227 also shows a sling seat supported on a metal frame.

Palmco Engineering sells a bathtub seat having a web with a zipper to enable lowering a patient's head to facilitate hair washing.

SUMMARY OF THE INVENTION

The present invention provides a relatively simple and inexpensive appliance by which a handicapped child can be transported from a bed to a bathtub and the patient and appliance placed in the tub without the attendant handling the entire weight of the patient. The appliance includes an elongated, generally rectangular frame with a foot run, head run, interconnecting side runs and a U-shaped fulcrum frame which surrounds the fabric seat to protect the patient. The fulcrum frame provides a fulcrum which is placed on the edge of the bathtub and enables lifting of the lower foot end of the frame upwardly to clear the edge of the tub. When the foot is elevated to clear the edge of the tub, the appliance is swung or pivoted about a vertical axis to place the foot end in the tub to support the appliance and patient, and then the patient and appliance are lowered as a unit into the tub by shifting the fulcrum bar from the edge of the tub. More specifically, wheels at the foot run provide a pivot for swinging the entire frame and patient as a unit laterally onto the edge of the tub, and the fulcrum bar, when rested on the side of the tub, enables the attendant to swing the foot portion upwardly and horizontally over the rim of the tub and then lower the foot portion into contact with the tub bottom, whereupon the fulcrum bar can then be lowered onto the floor of the tub, supporting the patient at an inclined sitting position in the tub. Wheels on the fulcrum bar aid in transporting the appliance on the floor.

Alternatively, the patient and appliance can be loaded in the tub by approaching the tub with the device at right angles to the longitudinal axis of the tub, tilting the appliance rearwardly about the wheels on the fulcrum bar to raise the front wheels above the rim of the tub. The frame can then be slid into the tub for a portion of its length and the attendant then picks up the appliance and patient and slides the frame over the tub rim. When the front wheels have contacted the bottom of the tub, the head end of the frame is swung into the tub.

A deep pocket in the web, which extends well below the side runs, forms a seat for the patient and, together with a seat belt, securely retains the patient in the appliance. The web is loose adjacent the frame foot portion to form a slight recess or pocket for the feet to aid in positively positioning the patient on the appliance. Foot straps are also provided.

The foot and head ends of the web are fastened to the frame by straps held by Velcro fasteners or the like. Hence the head panel can be released to enable lowering of the back of the patient's head in the water to facilitate shampooing.

Further objects, advantages and features of the invention will become apparent from the disclosure hereof.

DESCRIPTION OF THE DRAWINGS

FIG. 3 is a plan view of the appliance shown in FIG. 2.

FIG. 4 is an end view of the head end of the appliance shown in FIG. 2.

FIG. 11 is a diagrammatic plan view showing the pivot action of the appliance on the side of a bathtub.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figures 1, 2, 5:
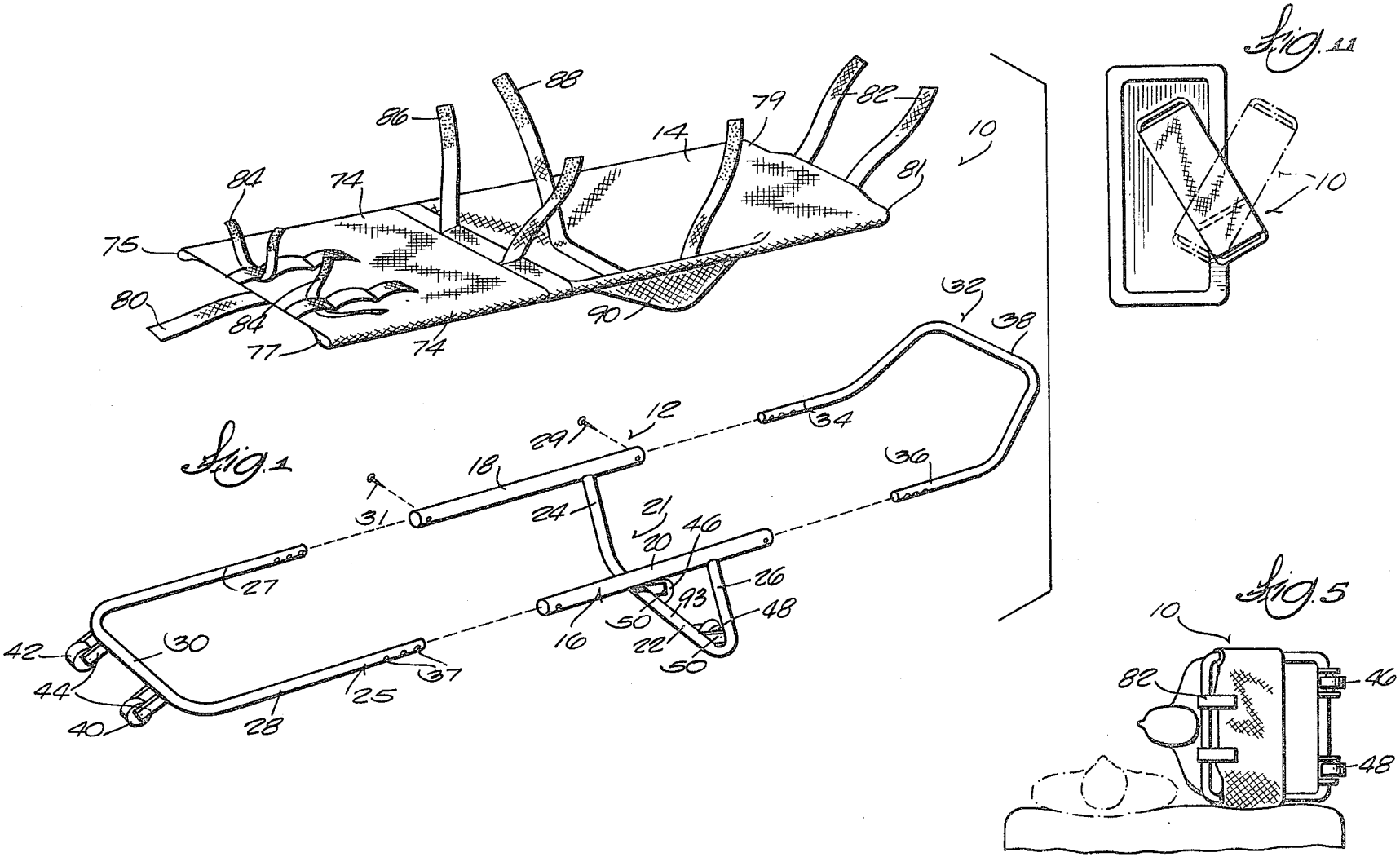
FIG. 1 is an exploded perspective view of the bathing appliance of the invention.
FIG. 2 is a side elevational view thereof.
FIGS. 5, 6, 7, 8, 9 and 10 are diagrammatic views showing the sequence of loading a patient from a bed into the appliance, transporting the patient to a bathtub and loading the patient and appliance into the tub as a unit.

FIG. 1 discloses an appliance 10 which includes a frame 12 and a mesh fabric web 14 which is supported by the frame 12, as subsequently described. The frame includes a mid or center portion 16 which has two side runs 18 and 20 and a U-shaped fulcrum frame 21 having a fulcrum bar 22 connected by leg portions 24 and 26. The frame also includes a foot section 25 with two side runs 27 and 28 connected by a cross run or foot run 30. The head section 32 includes side runs 34 and 36 and an inclined head rest portion 38. The ends of the foot and head frame sections interfit in telescopic relationship with the center frame 24. Apertures 37 and screws 29 can be employed to hold the telescoped frame parts in assembly. A sufficient number of apertures 37 are provided to afford adjustment of the length of the foot section. In Europe, where typical tub heights are 21 inches as compared with 15 or 16 inches in the United States, the additional length and the extended foot section provides better stability for the patient when loading the patient in the tub as hereinafter described.

The foot run 30 is provided with two casters or wheels 40 and 42 which are rotatably supported by ears or tabs 44 which are welded to the frame run 30. The center frame is provided with ears 50 which are welded to the fulcrum bar and which rotatably support wheels 46, 48.

The web 14 is desirably formed of one piece of mesh or imperforate material to enable drainage and has marginal sleeves 74 supporting the sides of the web on the side runs of the frame sections. The foot section runs 27 and 28 are inserted into sleeve openings 75, 77 and the head section runs 34, 36 are inserted in the sleeve openings 79, 81. Gaps 72 in the sleeves intermediate the ends (FIG. 4) enable insertion of the side runs 16, 18 of the central frame section, with the legs 24, 26 extending through the gaps. The foot end of the web is fastened to the frame by one or more straps 80 which are wrapped around the run 30 and secured with a Velcro fastener at the end. The head end of the web is secured to run 38 by straps 82 which are wrapped around the frame portion 38 and secured with Velcro fasteners. The web 14 is also provided with straps for holding the invalid on the appliance. Leg or foot straps 84, leg straps 86 and a waist strap 88 are provided. The straps are stitched to the web fabric. The web 14 also has a formed-in seat portion or deep pocket 90 which retains the hips of the invalid well within the side frames during use. The pocket also lowers the center of gravity of the device to prevent tipping when the appliance and patient are unattended. Looseness of the web in the foot portion helps positively position and retain the patient against shifting.

Figure 8:
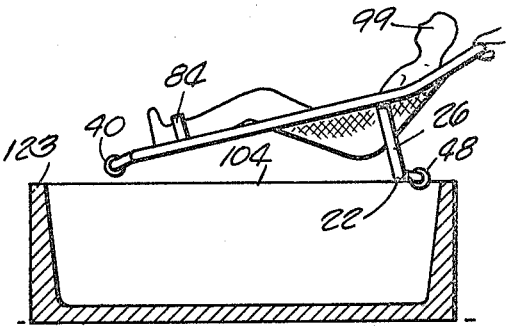

The pocket 90 is desirably located within the fulcrum frame so that the frame will protect the patient's hips and buttocks. Moreover, when the appliance is being pivoted as illustrated in FIG. 8, the pocket is located so that the appliance is balanced with respect to the fulcrum bar for maximum stability as the appliance is swung laterally. When the appliance is at rest in the FIG. 2 position, with all wheels on the floor or ground, the center of gravity is desirably forwardly of the wheels 46, 48 so the appliance won't tip backward.

Figure 6:
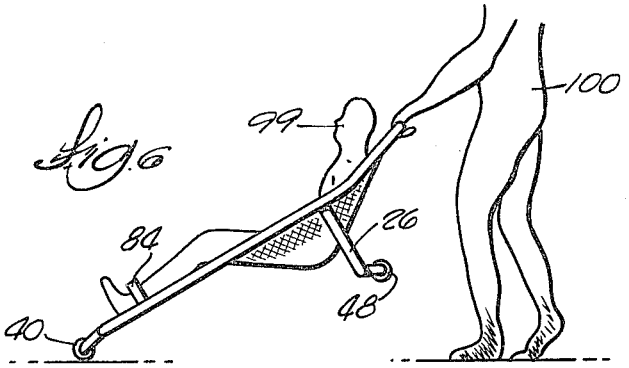

In use, the appliance can be positioned on a bed adjacent to the patient (FIG. 5) and the patient placed on his or her side and shifted laterally onto the appliance and strapped in place. The patient and appliance can then be rolled into the upright position on the bed and the front wheels lowered onto the floor. When the appliance is in the FIG. 5 position, the laterally projecting fulcrum frame aids in supporting the frame and patient. In FIG. 6, the attendant 100 is transporting the patient 99 either with all four wheels on the floor or with the front wheels 40, 42 on the floor, depending on the weight of the patient and the height of the attendant.

Figure 7:
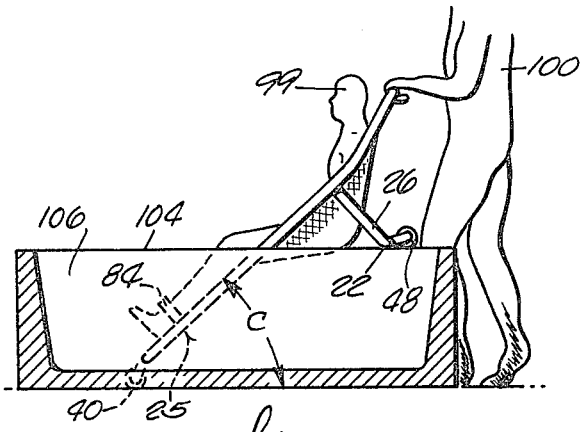
Figure 9:
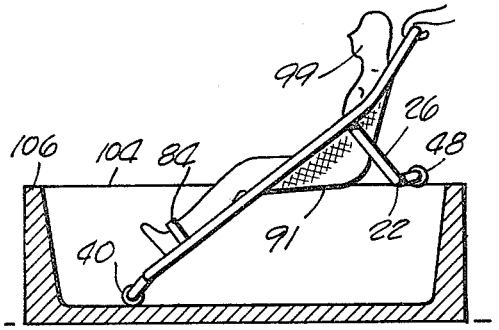
Figure 10:
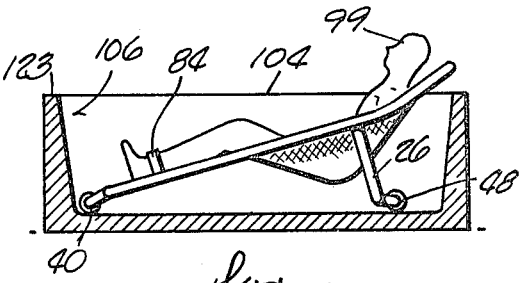

To load the patient and appliance into the tub, as illustrated in FIGS. 7–11, the appliance is moved parallel to the side of the tub, as illustrated in FIG. 7. In FIG. 7 the attendant has lifted the fulcrum bar 22 up and placed it on the edge or rim 104 of the tub 106, with the foot section 25 remaining exteriorly of the tub. The attendant then pivots the device to raise the front wheels upwardly, as illustrated in FIG. 8, to clear the rim 104. The foot 24 is then swung over the rim, as illustrated in FIG. 11, so that the front wheels can be placed in the tub, as illustrated in FIG. 9. The patient and appliance can then be lowered into the tub, as illustrated in FIG. 10. When the device is supported in part on the edge of the tub, as illustrated in FIGS. 7, 8 and 9, the angle A between the wheels and the fulcrum support is such that there will be clearance between the bathtub side rail 104 and the wheels so as not to interfere with the swinging movement of the device during the FIGS. 7 through 9 sequence. It is also desirable that the wheels extend rearwardly at an appropriate angle to minimize the height of the appliance when in the tub for maximum immersion of the patient. The angle of the tabs holding the front wheels 40 and 42 is also intended to minimize the overall height of the patient in the tub.

Figure 12:
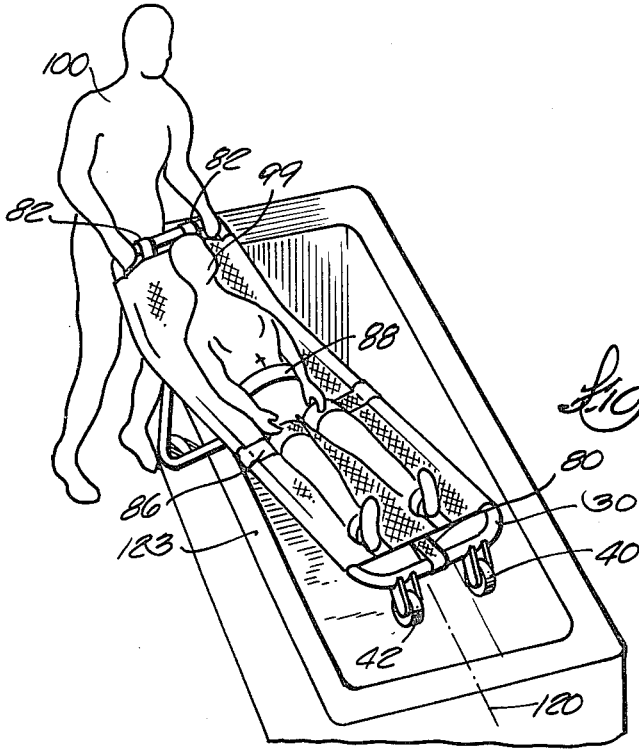
FIG. 12 is a perspective view showing the loading technique illustrated in FIG. 11.

FIG. 12 shows the patient and appliance being supported on the fulcrum bar on the rim of the tub during the pivoting or swinging action to place the foot end of the appliance in the tub prior to lowering the fulcrum bar to the bottom of the tub. Referring to FIG. 2, certain dimensional relationships of the components have been found to maximize the advantages of the invention and position the seat portion 91 of the pocket 90 in a generally horizontal position when the device is in the FIG. 7 and FIG. 9 positions. An appliance with a length L of $47\frac{1}{2}$ inches and height H of 20 inches and pocket depth P of 8 inches has provided good results. With these dimensions, the angle B (FIG. 2) of 15° to 20° will provide an angle C (FIG. 7) of between 35° and 45° to hold the seat horizontal. An angle higher than 50° will not provide the desired stability and security for the patient during manipulation into the tub. Adjustment of the length of the foot section to provide an angle within this range is desirable.

If it is desired to lower the patient's head partially in the water to facilitate washing and shampooing, the straps 82 can be unfastened and the head portion of the web pushed down on the frame over the tubes a selected amount to enable lowering of the patient's head the desired depth.

Figure 13:
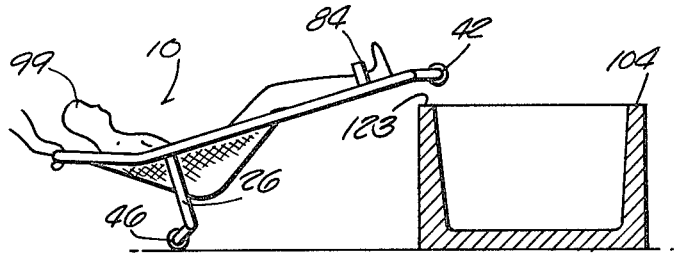
FIGS. 13 and 14 show an alternate technique for loading the patient and appliance as a unit.
Figure 14:
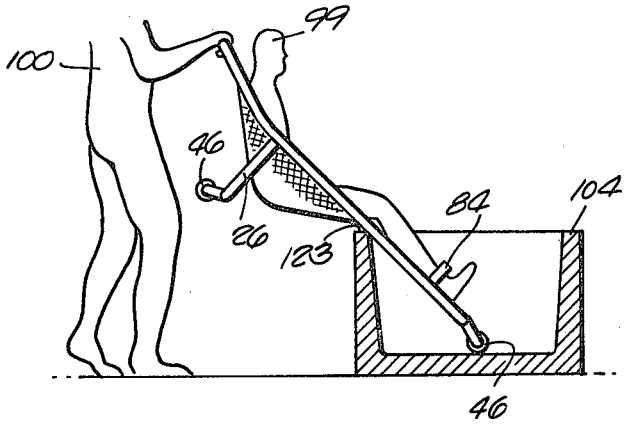

FIGS. 13 and 14 show an alternate procedure for loading the appliance and patient into the tub. In FIG. 13 the appliance 10 is approaching the tub at generally right angles with the longitudinal center line 120 of the tub. The appliance is tilted rearwardly about the fulcrum frame 22 and the wheels 48 to lift the foot end 25 above the rim 123 of the tub. The front frame sections 27 and 28 are then slid over the rim of the tub and the patient and appliance tilted as illustrated in FIG. 14 to touch the front wheels on the floor of the tub. Once the front wheels have touched the floor of the tub, the patient and appliance are swung to align the appliance with the longitudinal center line 120 of the tub and the patient is lowered into the tub. The sequence can be reversed for removing the patient and appliance from the tub. With the technique illustrated in FIGS. 13 and 14, as with the technique previously disclosed, the attendant does not have to handle the entire load at all times because the rim 123 of the tub supports part of the load.

A skidproof coating 93 on the bar 22 facilitates handling of the device on the tub rim.

The use of straps with Velcro fasteners enables adjustment of the length of the frame to accommodate patients of different heights. However, other types of fastening techniques could be employed.

What is claimed is:

1. A device for transporting a patient to a bathtub and for supporting the patient in the bathtub during bathing, said device comprising an elongated generally rectangular frame including first and second side runs, a foot run and a head run, with said foot run being generally co-planar with said side runs to minimize the height thereof when said device is supported in a bathtub, a web connected to said runs to support a patient thereon and the patient's legs in a generally straight position, said web including a seat portion which forms a pocket extending substantially below the side runs and including means for loading the appliance and patient into a bathtub without requiring the attendant to handle the entire load, said means comprising a U-shaped fulcrum frame which surrounds the pocket to protect the hips of the patient and has a lower fulcrum run for supporting the device and patient on the rim of a tub for pivoting the frame about a vertical axis to swing the foot of the frame and the patient from a first position with the feet of the patient outside the tub to a second position with the foot of the frame in the tub and to support the patient in an inclined position in the tub, and support means on said fulcrum bar projecting rearwardly therefrom to minimize forward slippage of said device during swinging movement of said device while supported on the rim of the tub.

2. A device in accordance with claim 1 wherein said support means includes ears connected to said fulcrum bar and means for connecting said ears to said fulcrum bar, with said ears extending rearwardly at an oblique angle below the fulcrum bar to maximize the depth of immersion of a patient in the tub.

3. The device of claim 1 wherein the frame is formed from a front U-shaped foot section and said rear frame is formed from the second U-shaped section which are telescopically received by a midsection which is also connected to a generally U-shaped fulcrum and pivot bar.

4. The device of claim 1 wherein a plurality of apertures are provided in said telescopically related frame sections to afford adjustment of the length of the foot section to facilitate loading in tubs having different heights.

5. A device in accordance with claim 1 wherein said web includes sleeves telescoped over said frame side runs, and means detachably connecting the end of said web adjacent said head run to enable shifting of said web along said frame to permit lowering of the patient's head through the frame for washing the patient's hair.

6. A device in accordance with claim 1 wherein said fulcrum bar is provided with an antiskid coating.

7. A device for transporting a patient to a bathtub and for supporting the patient in the bathtub during bathing, said device comprising an elongated generally rectangular frame including telescopically connected tubular foot, center and head frame sections, a web connected to said frame sections to support a patient thereon, said web including a seat portion which forms a pocket extending substantially below the sides of the center frame section, said frame being shaped and proportioned to enable loading the device and patient into a bathtub without requiring the attendant to handle the entire load, including wheels on the foot section, and a U-shaped fulcrum frame portion surrounding said pocket, with the low point of the pocket closely adjacent the fulcrum bar so that the center of gravity of the load is close to the fulcrum bar, with said fulcrum bar affording pivoting the frame about a vertical axis to swing the foot of the frame and the patient from a first position with the feet of the patient outside the tub and a second position with the foot section within the tub, and wherein said appliance and patient are in balance when said fulcrum bar is supported on the rim of a tub.

* * * * *